US006626389B2

(12) United States Patent
Kagel

(10) Patent No.: US 6,626,389 B2
(45) **Date of Patent: *Sep. 30, 2003**

(54) RETRACTABLE MODEM CORD DEVICE WITH SPINNING DISPLAY

(75) Inventor: David Kagel, Calabasas, CA (US)

(73) Assignee: Magnet, LLC, Washington, MO (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/023,212

(22) Filed: Dec. 17, 2001

(65) Prior Publication Data

US 2002/0053622 A1 May 9, 2002

Related U.S. Application Data

(63) Continuation-in-part of application No. 09/595,124, filed on Jun. 16, 2000, now Pat. No. 6,364,237.

(51) Int. Cl.[7] ..... B65H 75/48; A63F 1/18; G09F 11/04

(52) U.S. Cl. ..... 242/379; 242/371; 273/142 R; 40/495

(58) Field of Search ..... 242/379, 379.2, 242/371, 400; 273/142 R; 446/243, 247, 248, 249; 40/495; 33/761

(56) References Cited

U.S. PATENT DOCUMENTS 812,150 A * 2/1906 McLean ..... 242/379
1,443,194 A * 1/1923 Pichler ..... 242/379.2
1,942,006 A * 1/1934 Shikaly ..... 446/249
2,732,148 A * 1/1956 Lummis ..... 242/379.2
3,524,273 A * 8/1970 Shore ..... 40/495
3,968,670 A * 7/1976 Quenot ..... 242/379
4,028,843 A * 6/1977 Appel ..... 446/249
4,555,235 A * 11/1985 Burroughs ..... 446/243
4,692,034 A * 9/1987 Fukui et al.
4,953,809 A * 9/1990 Barrus ..... 242/379
5,815,873 A * 10/1998 Jones
5,833,165 A * 11/1998 Paugh ..... 242/379.2
5,996,932 A * 12/1999 Wang
6,364,237 B1 * 4/2002 Kagel ..... 242/379
6,460,800 B1 * 10/2002 Watanabe et al.

* cited by examiner

*Primary Examiner*—William A. Rivera
(74) *Attorney, Agent, or Firm*—Lyon & Harr, LLP; Richard T. Lyon

(57) ABSTRACT

A retractable modem cord device wherein a window in the front face of the case of the device is provided, through which a design, such as a pattern, inscription, or logo can be seen. When a retractable cord of this device is pulled out of the case it causes the design to rotate or spin. Likewise, when the cord is retracted back into the case of the retractable modem cord device, the design spins. Thus, anyone observing the retractable modem cord device will see the spinning design. It is believed this spinning design will be interesting to observers, thus lending special appeal to the device.

29 Claims, 6 Drawing Sheets

RETRACTABLE MODEM CORD DEVICE WITH SPINNING DISPLAY

CROSS-REFERENCE TO RELATED APPLICATIONS

This application is a continuation-in-part of a prior application entitled "Retractable Badgeholder With Spinning Display" which was assigned Ser. No. 09/595,124 now U.S. Pat. No. 6,364,237 and filed Jun. 16, 2000.

BACKGROUND

1. Technical Field

This invention relates to a retractable modem cord, and more specifically to such a modem cord incorporating a spinning display.

2. Background Art

Most modern computers include a modem device for connecting the computer to the telephone system. Typically, this is done using a standard telephone cable (or cord as it is usually referred to) constructed of an insulated cord containing conductors with plugs at either end, typically so-called RJ-11 connectors. One of the connectors is plugged into a socket on the computer that interfaces with the modem device and the other connector is plugged into a similar socket in the room in which the computer is being used. This latter socket interfaces with the telephone system. Typically, these sockets are so-called RJ-11 jacks. Alternately, the modem can be a stand-alone device which is connected to the computer. In such a case, one of the connectors is plugged into a jack on the modem device, in lieu of the computer, and the other end is plugged into the telephone system jack. In a home or office setting where the computer is typically a desktop computer, a dedicated telephone cord is used to make the above-described connection. It is usually plugged into the computer and the telephone jack and left undisturbed.

However, with the increased popularity of mobile computing, desktop computers are replaced with laptop, notebook, or hand-held computers. A user of such portable computing devices connects the device to the telephone system at whatever location he or she may be at the time, such as hotel rooms, airport waiting areas, and a myriad of other locations. To make the connection, the user must have a telephone cord, as described above. While, a standard telephone cord is often carried around by the user for this purpose, these cords can be somewhat cumbersome. Particularly, a user will typically have to coil the telephone cord to make it convenient for storing and transporting. The coiled cord must then be un-coiled for use. Often the cord becomes unraveled during storage, thereby making it difficult to retrieve. In addition, in the process of uncoiling the cord, it often becomes tangled, and must be untangled in order to use it. Recently, convenient devices for preventing these types of problems have come into use. The device is often referred to as a retractable model cord.

A retractable modem cord is a device having a case inside of which is a reel with a modular-type telephone cord wrapped around it. The reel is configured such that either of the free ends of the cord, which are connected to the aforementioned telephone plugs or connectors, protrude from the case and can be pulled away from the case, thereby rotating the reel, and allowing the cord to un-wrap from the reel. As the cord unwraps from the reel, both end of the cord are extended from the case, even if only one of the cord ends is pulled. The cord is permanently attached at approximately mid-length to the reel so that the cord is never fully extracted from the retractable modem cord case. However, most of the cord can be pulled from the case and used to connect a user's computing equipment to the telephone system, as described above. The reel is spring loaded in that as the cord is being pulled from the case, a spring comes under tension. This spring would retract the cord back into the case, if the reel could rotate freely in the opposite direction than it was rotated to extend the cord. However, this is temporarily precluded from happening by a locking device which allows the reel to rotate in the direction necessary to extend the cord, but not in the reverse direction. Thus, once extended the cord remains so while in use. Once the user is done with the cord and has disconnected it from the computing device and the telephone system jack, a manually-activated release accessible from the outside of the case is used to release the reel locking mechanism. The spring which is still under tension then rotates the reel in a "take-up" direction and the two halves of the cord are automatically reeled back into the case. The openings in the case through which the two halves of the cord extend and retract, as well as the pathway from the reel to the openings are configured to cause the cord to wind onto the reel smoothly without kinking or tangling. The case can then be easily stored and transported by the user. Thus, it can be seen that the retractable modem cord eliminates the problems of having to coil and uncoil the telephone cord, as well as the problems associated with the cord becoming unraveled during storage or tangled when being uncoiled.

The above-described retractable modem cord devices are relatively inexpensive to manufacture and have become popular as promotional products where a design or logo is imprinted on the outside of the case where it is visible to the user and others. These designs and logos are intended as advertising and as a bonus make what could otherwise be an inconspicuous device into an item of interest to bystanders, thus making the device a source of free publicity for the company or organization whose design is imprinted on the outside of the device.

SUMMARY

The present invention is directed toward an improvement to the existing retractable modem cord devices described above. This improvement involves creating a window in at least one face of the case of the device, through which a design, such as a pattern, inscription, or logo can be seen. When the cord of this improved retractable modem cord device is pulled out of the case it causes the design to rotate. Likewise, when the cord is retracted back into the case, the design spins. Thus, anyone observing the retractable modem cord device will see the spinning design. It is believed this spinning design will be even more interesting to observers, thus lending special appeal to the improved retractable modem cord device.

More specifically, the retractable modem cord device according to the present invention includes a case having a viewing port on its front side through which a rotating display plate can be seen. This viewing port can be open to the outside, or if desired, it could be formed using a transparent window. The display plate has a design on its exterior facing side which is visible from the outside through the viewing port. The retractable modem cord device also includes a telephone cord, which in one mode is fully retracted within the case with the exception of the two free ends of the cord that extend outside the case through separate openings in its periphery. The two ends of the cord terminate in the previously-described telephone-type connectors. The connectors are larger than the openings in the periphery of the case, and so the free ends of the cord are prevented from retracting completely into the case. In the fully retracted mode, the tension applied to the cord is sufficient to hold the connectors against the periphery of the case. In addition, there are two nooks formed in the case just outside of the openings through which the ends of the cord extend. Each connector is housed within the confines of a different one of the nooks when the cord is completely retracted. The result is that in the retracted mode, the connectors are held within the nooks, which provides a degree of protection to the connectors during storage and transport of the retractable modem cord device. The cord can be manually extended from the case by a user, so that the cord can be used to connect the modem associated with a computing device to the telephone system. Specifically, the cord is manually extended from the case by a user pulling on either of the two ends of the cable via the connector. The connectors are still readily accessible when housed in the nooks so as to allow a user to grasp one or both of the connectors to pull on them and extend the cord. In the case where the user pulls on just one of the connectors, the end not pulled is extended automatically, thereby extending both ends of the cord simultaneously. In this way the two ends of the cord are played out, with the case of the device remaining approximately at the mid-point of the extended length of the cord. The retractable modem cord device also includes a locking and release mechanism that has lock which once the cord has been extended by the user prevents the cord from retracting back into the case, despite the influence of the tension on the cord. Thus, the user pulls the cord to the desired length, or to its fully extended length, and then lets go of the connector(s). The lock of the locking and release mechanism prevents the cord from being retracted. The user then plugs the connectors into the modem jack on a computing device (or directly into the modem if it is a stand-alone unit) and into the telephone system jack, respectively. When the user is done using the modem connection, he or she unplugs the respective connectors, and manually activates a release that is part of the locking and release mechanism. This release is used to release the lock, thereby allowing the cord to be retracted back into the case under the influence of the tension on the cord.

Whenever, the cord is extended or retracted, the aforementioned display plate rotates, thus providing an interesting spinning design. The design on the display plate can be incorporated in a number of ways. For example, the design could be formed as part of the exterior facing surface of the plate, such as by embossing or engraving. The design could also be formed over the surface of the exterior facing side of the display plate. This could be accomplished using paint or ink. Alternately, the display plate could be made using a label and a backing plate. In this later case, the design would be on a front side of the label which acts as the exterior facing side of the display plate. This label is attached to the backing plate by its back side to complete the display plate.

The case of the retractable modem cord device can have any desired shape. For example, the case when viewed from its front side can have a shape approximating a circle, ellipse, or some form of a polygon (e.g., a triangle, square, rectangle, hexagon, etc., or a combination thereof). The viewing port can also take on any desired shape, and need not be the same as the case. Likewise, the display plate can have any desired shape, although a circular disc shape is preferred to facilitate its rotation within the case. In one version of the present retractable modem cord device, the display plate is flush with the interior surface of the case adjacent the viewing port. In another version, the viewing port is an opening in the case and the display plate extends through the opening. Typically, with this latter version, the display plate extends only far enough to be flush with the exterior surface of the case adjacent the viewing port, although this need not be the case if it is desired that the display extend outside the case.

In addition to the just described benefits, other objectives and advantages of the present invention will become apparent from the detailed description which follows hereinafter when taken in conjunction with the drawing figures which accompany it.

DESCRIPTION OF THE DRAWINGS

The specific features, aspects, and advantages of the present invention will become better understood with regard to the following description, appended claims, and accompanying drawings where:

DETAILED DESCRIPTION OF THE PREFERRED EMBODIMENTS

In the following description of the preferred embodiments of the present invention, reference is made to the accompanying drawings which form a part hereof, and in which is shown by way of illustration specific embodiments in which the invention may be practiced. It is understood that other embodiments may be utilized and structural changes may be made without departing from the scope of the present invention.

Figure 1A:
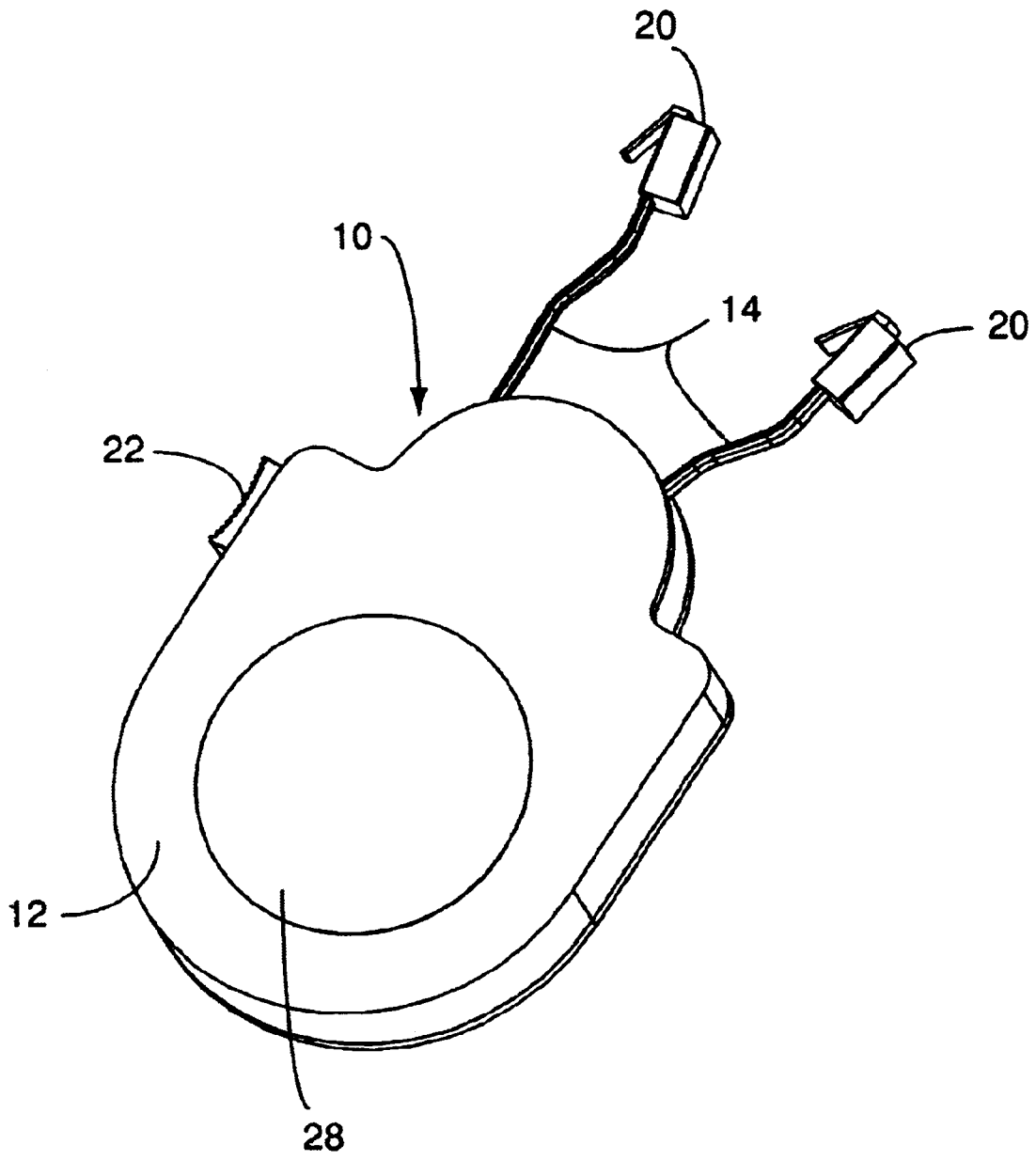
FIG. 1A is a front view of a retractable modem cord device according to the present invention.
Figure 1B:
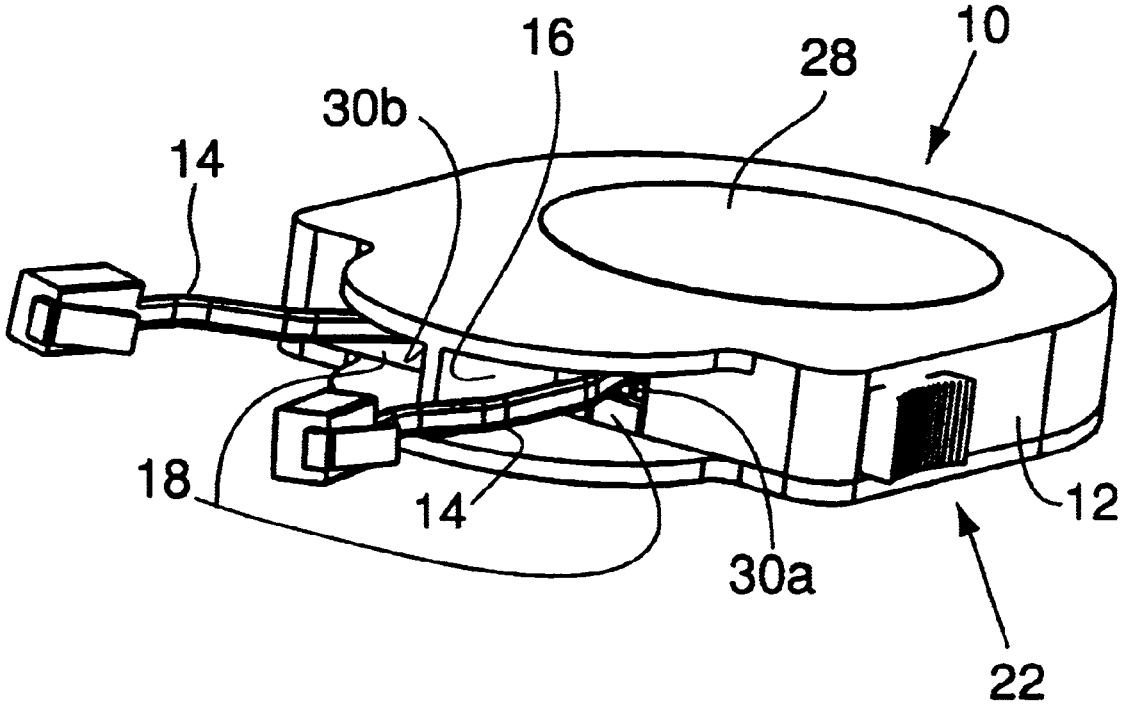
FIG. 1B is a side view of a retractable modem cord device according to the present invention.

FIGS. 1A and 1B depict a retractable modem cord device 10 embodying the present invention. Generally, the retractable modem cord device 10 has a case 12 inside of which is an extendable and retractable telephone cable 14, which is usually referred to as a telephone cord. The terms cable and cord will be used to mean the same thing for the purposes of this description. The telephone cord 14 is a standard insulated telephone cable having embedded conductors positioned in a planar, parallel relationship and encapsulated within a thin, ribbon-like jacket that acts to insulate each conductor for the others. In addition, this ribbon-like jacket facilitates the cord 14 being wound up onto a reel as will become apparent later. The general shape of the case 12, as best shown in FIG. 1A, can be described as having three sections. The first section, which is opposite the end of the case 12 where the ends of the cord 14 extend, is semi-circular. The middle section is approximately rectangular with sides that flare outwardly away from the first section. The last section is again semi-circular, but with a smaller diameter, and centered on the end of the middle section opposite the first section. As best seen in FIG. 1B, the width of the last section is open, with the exception of a central wall 16 extending perpendicularly away from the end of the second section to the outside edge of the last section. This structure results in the formation of two nooks 18 which house connectors 20 attached to the ends of the cord 14. The middle section, also has two rectangular openings 30*a* and 30*b* on either side of the aforementioned central wall 16 of the last section. These openings 30*a* and 30*b* lead to the interior of the case 12, and are the exit points for the ends of the cord 14. The connectors 20 that are attached to each end of the cord 14 are larger than the openings 30*a* and 30*b* and so act to prevent the cord 14 from completely retracting into the case 12. While the appearance of the case 12 has been described in connection with a tested embodiment of the present retractable modem cord device 10, it can have any shape desired, such as an elliptical shape (e.g., oval) or polygonal shape (e.g., triangular, square, rectangular, hexagonal, etc.), or any combination of shapes, as desired. The only requirement is that it have internal spaces capable of accommodating the reel and locking mechanisms that are to be described shortly.

As will be explained later in this description, the cord 14 is under tension from within the case 12 such that it tends to want to retract into the case. In a fully retracted mode, the connectors 20 attached to the ends of the cord 14 are pulled against the exterior of the case 12 within the aforementioned nooks 18. These open nooks 18 provide a degree of protection to the connectors 20 during storage, while still making the connectors readily accessible so that a user can pull one or both of them out of their respective nook 18 with ease.

The retractable modem cord device 10 is operated by a user pulling one or both of the connectors 20 away from the case 12. The cord 14 contained within the case 12 is played out as the user pulls. It is noted that the length of the cord 14 is can be any length, but should be made long enough to accommodate attaching a computing device to a telephone system jack that is located within a reasonable distance from the computer. For example, in tested embodiments of the present invention, the cord 14 was made approximately 8 feet long. The user can stop pulling at any point up to where the entire length of the extendable portion of the cord 14 is extended from the case 12. Whenever the user stops pulling, a locking and release mechanism 22 prevents the cord 14 from retracting into the case, despite the tension placed on the cord. Thus, when the user has pulled a length of cord out of the case 12 that is sufficient to connect his or her computing device (or stand-alone modem) to a telephone system jack, the user stops pulling. The cord 14 remains extended during use. When the user is finished using the cord 14, he or she disconnects the connectors 20 from the computing device and telephone system jack, and activates a release 24 (see FIG. 2A) of the locking and release mechanism 22. This releases a lock 26 (see FIG. 2A) of the mechanism 22 that was preventing the tension on the cord 14 from retracting the extended portion back into the case 12. As a result the cord 14 is pulled into the case 12 and the connectors 20 are seated into their respective nooks 18. The retractable modem cord device 10 can then be conveniently stored and transported until it is needed again.

A display 28, such as a design, pattern, inscription, or logo (collectively referred to hereinafter as a design), is visible from one face of the case 12 which will be designated the front face for the purposes of this description. When the cord 14 is pulled out of the case 12 or retracted back into the case, the display 28 rotates thereby providing an interesting visual presentation to anyone looking at the retractable modem cord device 10. In other words, someone observing the device will see the spinning design. This spinning design will draw the attention of an observer who may not have otherwise been focused on it. It is believed that purchasers of retractable modem cord device 10 devices will find the spinning design more interesting than the conventional models.

Having generally described the exterior appearance, components and operation of a retractable modem cord device 10 embodying the present invention, the internal mechanisms for achieving the automatic retraction of the cord 14 or locking of the cord in an extended position, and the spinning of the display 28 will now be presented. It is noted that this internal mechanism is only an example of one preferred embodiment and it is not intended that the present invention be limited to just this embodiment. Rather, any mechanisms that extend and retract the cord 14, and causes the display 28 to spin when the cord 14 is extended or retracted, could be substituted. The important aspect is that the display 28 rotates, not particularly how it is made to rotate.

Figure 2A:
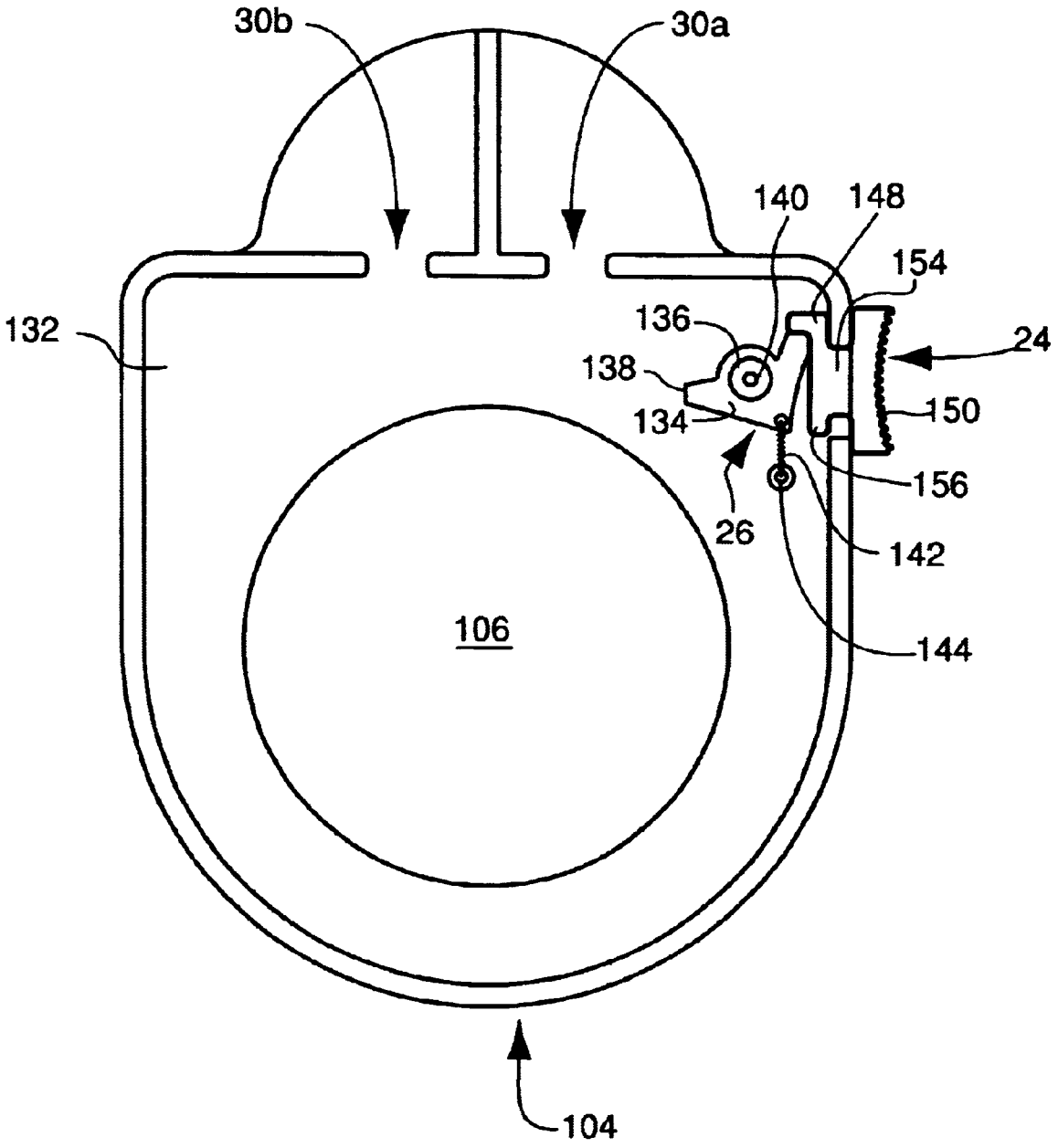
FIG. 2A is view of the components making up some of the internal mechanisms of the retractable modem cord device of FIGS. 1A and 1B, as viewed looking into the interior of the cover of the device.
Figure 2B:
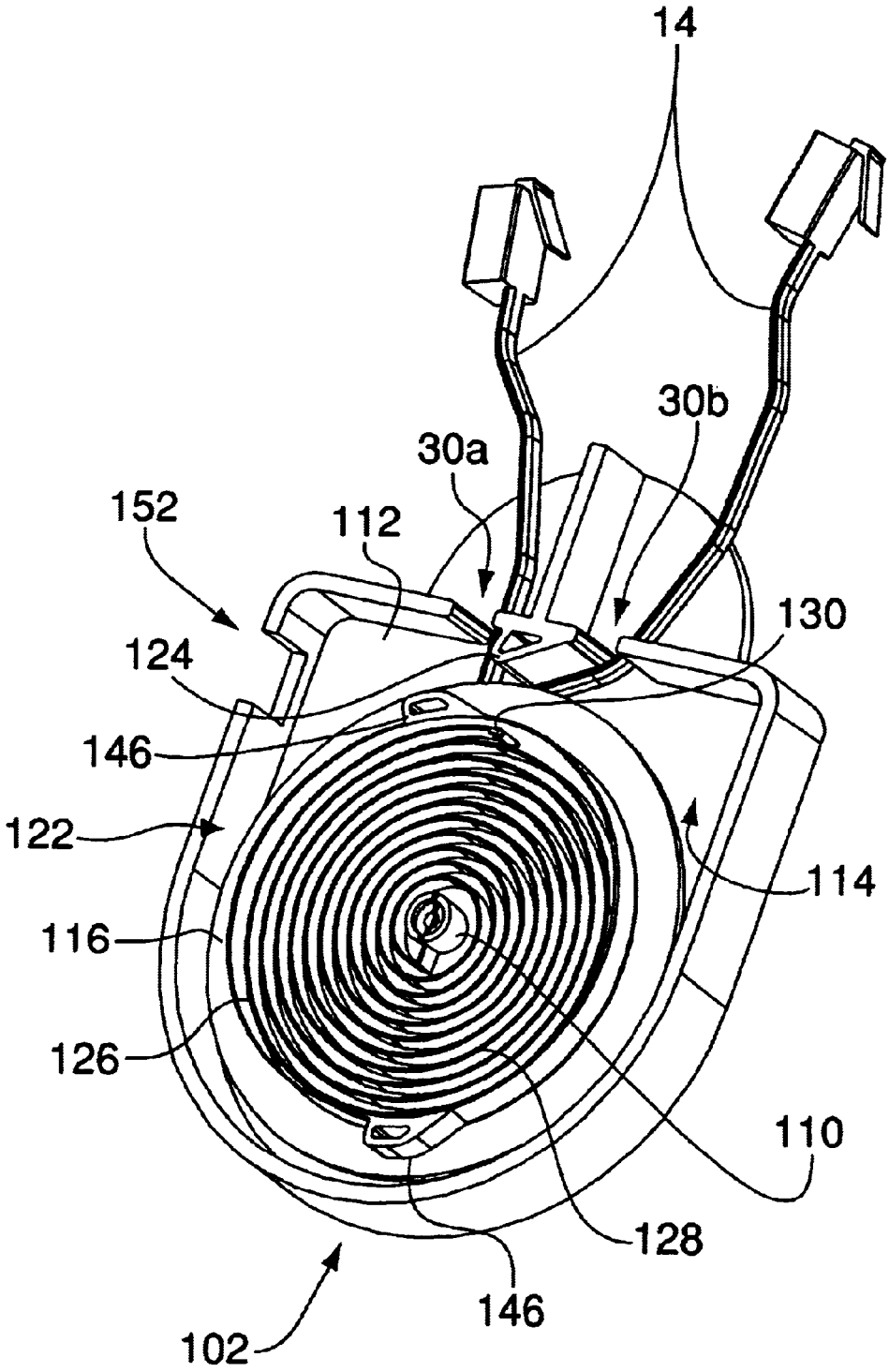
FIG. 2B is view of the components making up some of the internal mechanisms of the retractable modem cord device of FIGS. 1A and 1B, as viewed looking into the interior of the back piece of the device.
Figure 2C:
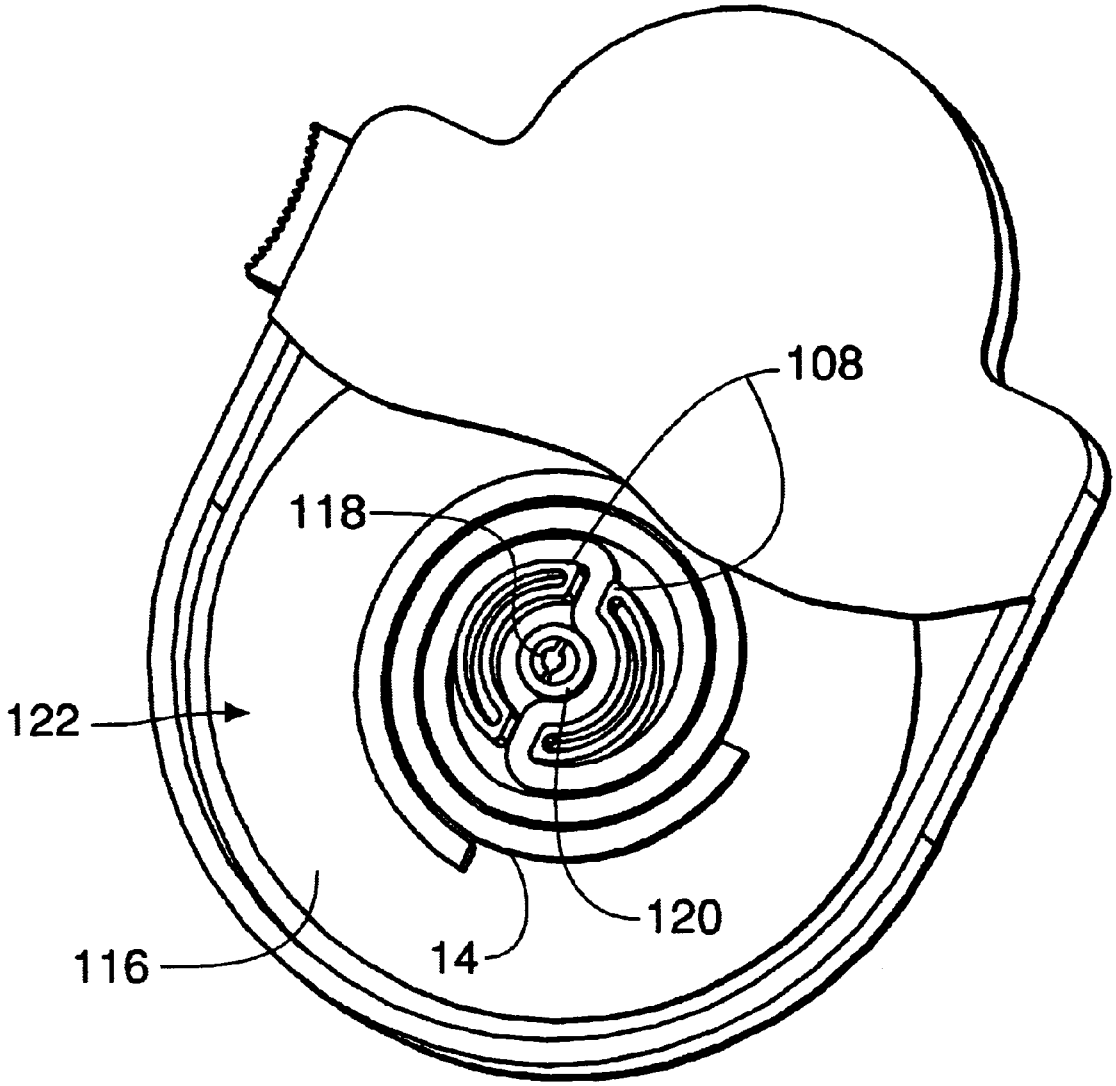
FIG. 2C is partially cut-away view of the retractable modem cord device of FIGS. 1A and 1B looking into the device from the back side thereof and showing some of the components making up the device.

Referring to FIGS. 2A–C, the case includes a back piece 102, and a cover 104, each of which is can be formed from molded plastic, metal or any other appropriate casing material. The cover 104 has an opening 106 through which the display can be seen. Optionally, the opening 106 can be bridged with a transparent window (not shown) to prevent contaminants from getting into the interior of the case, or as in tested embodiments of the present invention the display can extend from the interior of the case through the opening 106, thereby sealing the opening to some extent. It is noted that while the opening 106 in the cover 104 is shown as being circular, and should be circular for those embodiments where the display extends through the opening, it can have other desired shapes in those embodiments where the display is completely internal to the case.

The back piece 102 of the case has a centrally-located slotted post 110 that protrudes up perpendicularly from its inner wall 112. A reel 114 is disposed within the interior space of the case. The reel 114 has a disc shaped wall 116, with a central hole 118 (as best seen in FIG. 2C). A tube 120 extends out from the exterior-facing side of the wall 116 along the peripheral edge of the central hole 118. The central hole 118 and the interior diameter of the tube 120 slightly exceeding that of the slotted post 110. The reel 114 is free to rotate about the slotted post 110 within the interior space of the case owing to the diameter of the slotted post being slightly smaller than that of the central hole 118 of the reel and the interior diameter of the tube 120.

Two, semi-circular, crescent-shaped projections 108 also protrude out from the exterior-facing side of the wall 116, and surround the tube 120 without touching each other. These crescent-shaped projections 108 extend out the same distance as the tube 120. A circular cavity is formed between the radially inward facing walls of the projections 108 and the exterior of the tube 120. In addition, because the crescent-shaped projections 108 do not touch, pathways are formed from opposite sides of the circular cavity to the outside of the crescent-shaped projections. The tube 120 and crescent-shaped projections 108 form a structure that is used to anchor the cord 14 at approximately its mid-length. Essentially, the cord 14 enters through one of the pathways, is routed around the outside of the tube 120 within the central cavity, and out the opposite pathway. The reel 114 is installed onto the slotted post 110, and the tube 120 and projections 108 of the reel abut the interior facing wall 112 of the back piece 102, so as to define a spool structure 122 onto which the cord 14 is wound. Specifically, the cord 14 is wound around a hub created by the outside walls of the crescent-shaped projections 108. The two lengths of the cord 14 that extend out of the aforementioned pathways on opposite sides of the hub, are wrapped around the hub such that the two lengths interlace. The space bounded by the hub, the exterior face of the reel's disc-shaped wall 116, and the interior facing wall 112 of the back piece 102, form the take-up portion of the aforementioned spool structure 122. This space is made large enough such that both lengths of the cord 14 that extend from the hub can be completely wound up within the space, expect for a short portion at their ends that extend from spool structure 122 and through the openings 30*a* and 30*b* where they are attached to the connectors. A separation post 124 having an approximately triangular cross-section, as best seen in FIG. 2B, extends from the interior facing wall 112 of the back piece 102 just inside and approximately between the openings 30*a* and 30*b* in the case. The ends of the two length of the cord 14 exit the spool structure 122 just adjacent the separation post 124, and are routed on either side of the post and out the openings 30*a* and 30*b*. The end of the length of the cord 14 that is on the outside of the wound cord 14 is routed through the closer of the two openings 30*a* and 30*b*, and the other end is routed through the further opening.

The reel 114 also has an annular wall 126 that extends out from the interior face of the reel's disc-shaped wall 116. The annular wall 126 defines a nearly circular central cavity having a diameter somewhat smaller that the disc-shaped wall 116, and through the middle of which extends the slotted post 110. A wind-up spring 128 is disposed within the central cavity defined by the annular wall 126. The spring 128 can be made of any resilient material, such as spring steel. The inner end of the spring 128 is secured in place by threading it through and around a slot in the slotted post 110. The spring 128 forms a convoluted winding within the central cavity. The outer end of the spring 128 is folded around a retaining post 130 that extends from the interior face of the reel's disc-shaped wall 116 near the periphery of the central cavity so as to secure the outer end of the spring 128 to the reel 114. Thus, the inner end the spring 128 is secured to the back piece 102 via the slotted post 110, and the outer end of the spring is secured to the reel 114.

As stated previously, the cord 14 is under tension and only the connectors keep it from fully retracting into the case. This tension on the cord 14 is created by the spring 128. Essentially, a wind-up spring wants to uncoil. Because one end of the spring 128 is anchored to the case via the slotted post 110 of the back piece 102 and the other end is attached to the reel 114, the result is a rotational force on the reel about the slotted post. Depending on how the spring 128 is attached between the slotted post 110 and the reel 114, the direction of the rotational force may be either clockwise or counterclockwise. Either direction is acceptable, as long as the cord 14 is wrapped around the reel 114 in the direction opposite of the rotational force on the reel. In this way the rotational force tends to want to wrap the cord 14 further onto the reel 114. In the embodiment of the retractable modem cord device 10 depicted in FIGS. 2A–C, the cord 14 is wound in a clockwise manner looking down into the interior of the back piece 102, and the spring 128 is configured to place a counterclockwise rotational force onto the reel 114. It is noted that if the situation is reversed, the cross-sectional shape of the separation post 124 should also be reversed to accommodate the ends of the cord 14 coming off of the spool structure 122 from the other direction.

In a fully retracted mode, the spring 128 is wound tight enough to ensure the connectors are captured within the nooks, but no so tight that the connection between the connectors and the cord 14 is jeopardized or that it becomes difficult to pull the cord out of the case against the spring 128. As the cord 14 is pulled out, the reel 114 rotates in relation to the case in a direction that causes the spring 128 to wind even more tightly. Accordingly, when the user releases the extended cord 14, the spring tension causes the reel 114 to rotate in the opposite direction so as to take up the cord 14 into the take-up space of the spool structure 122 in the interlaced manner described previously. As mentioned previously, the cord 14 remains extended once pulled from the case to a desired length (up to its full extended length). This is accomplished with the aforementioned locking and release mechanism that prevents the reel 114 from rotating under the spring force until a release 24 is activated by the user. The locking and release mechanism is best illustrated in FIG. 2A. The lock 26 is installed on the interior facing wall 132 of the cover 104. Essentially, it is a lever 134 having a pivot hole 136 near its mid-length. A lever extension 138 extends from one end of the lever 134 toward the opening 106 in the cover 104 at approximately a 45 degree angle. The lever 134 is installed onto a pivot post 140 protruding from the interior facing surface 132 of the cover 104 via its pivot hole 136 at a point offset from the opening 106 toward the periphery of the case and nearer to the edge of the case having the openings 30*a* and 30*b* than the opening 106. A small coil spring 142 is connected at one end to a spring post 144 that extends from the interior face 132 of the cover 104 near the periphery of the case and further away from the edge of the case having the openings 30*a* and 30*b*. The other end of the spring 142 is attached to the lever 134 at a point closer to the opening 106 than the pivot hole 136. This configuration causes the spring 142 to pull the lever extension 138 up toward the opening 106. The result is that the distal end of the extension 138 contacts the outside surface of the reel's annular wall 126. Two diametrically opposed ramp-like protrusions 146 extend radially out from the outside surface of the annular wall 126. The protrusions 146 are ramp-like in that there is an incline section originating at the outside surface of the annular wall 126 and sloping outward from the wall, and an abutment section that extends from the end of the incline section radially back to the annular wall. The incline section is oriented such that when the reel 114 is rotated in the direction which extends the cord 14 (e.g., counterclockwise when looking down into the interior of the cover 104 in the tested embodiments of the present invention), the lever extension 138 rides up the slope of the incline and back onto the outside surface of the annular wall section. Thus, the cord 14 can be pulled from the case without interference by the lock 26. However, when the user releases the extended cord 14 and the spring 128 begins to retract the cord, the reel 114 rotates only a few degrees (i.e., about 180 degrees maximum) before the lever extension 138, which is riding along the outside surface of the annular wall 126, comes into contact with the abutment section of one of the ramp-like protrusions 146. The force of the wound spring 128 rotates the end of the lever 134 opposite the lever extension 138 against a stop block 148 of the release 24 associated with the locking and release mechanism, thereby precluding it from rotating any further. As the lever extension 138 is long enough to still be in contact with the abutment section of the ramp-like protrusion 146, the rotation of the reel 114 is stopped and the portion of the cord 14 extended from the case at that point remains extended. The release 24 has an external slider 150 that is situated against the outside surface of the case adjacent a slot opening 152 (as best seen in FIG. 2B) in the side of the case that is formed by mating cut-out portions in the back piece 102 and cover 104. The external slider 150 is connected via a bridge piece 154 that extends through the slot opening 152 to an internal slider 156 that slides along the interior surface of the side of the case. The aforementioned stop 148 resides at the end of the internal slider 156 nearest the end of the case containing the openings 30*a* and 30*b*. The bridge piece 154 of the release 24 does not fill the entire slot opening 152, and is pushed against the end of the slot opening closest to the end of the case containing the openings 30*a* and 30*b* by the force of the reel 114 on the lever extension 138. To release the reel 114 so as to allow it to rotate under the influence of the wind up spring 128 and retract the cord 14, the user slides the external slider 150 away from the end of the case 12 containing the openings 30*a* and 30*b*. The release 24 moves along the slot opening 152, thereby pushing the end of the lock lever 134 with the stop block 148, and rotating the lever about the pivot post 140 against the force of the coil spring 142 so as to pull the lever extension 138 up and over the abutment section of the ramp-like protrusion 146, thereby freeing the reel 114 to rotate. The reel 114 will continue to rotate and retract the cord 14 until either the cord is fully retracted and the connectors stop the reel from rotating or the user lets go of the release 24 and the coil spring 142 pulls the end of the level extension 138 back against the annular wall 126 where it eventually contacts the abutment section of one of the ramp-like protrusions 148, thereby stopping the rotation of the reel.

Figure 3:
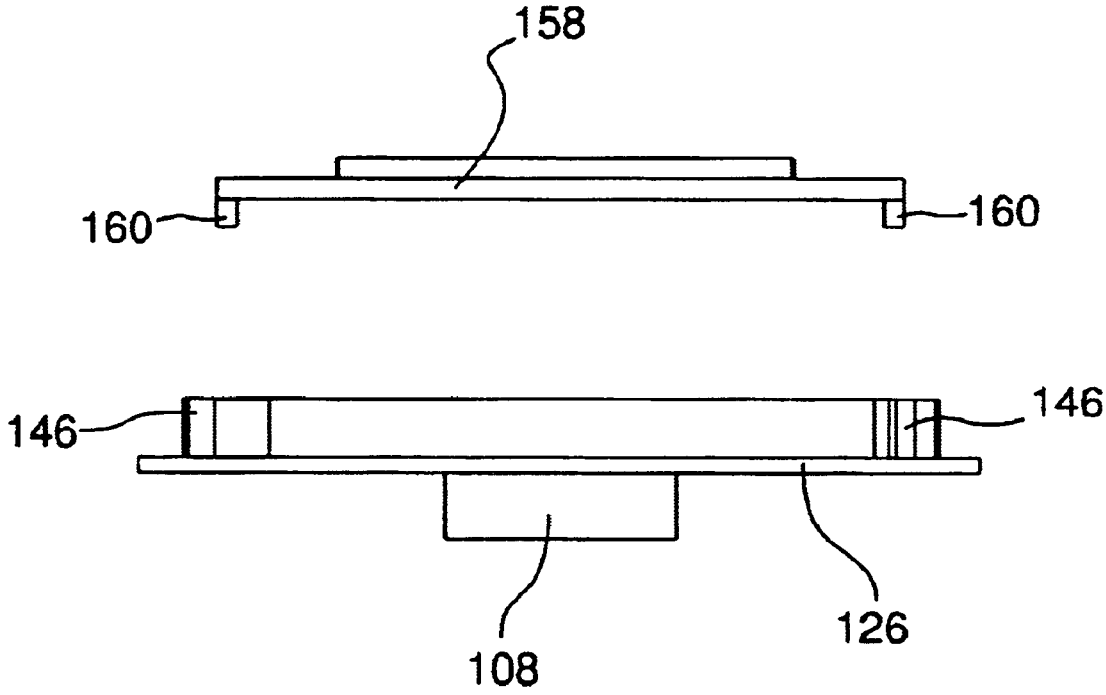
FIG. 3 is an exploded, side view of the reel and display disk of the retractable modem cord device of FIGS. 1A and 1B.

Referring to FIG. 3, the aforementioned display preferably takes the form of a disc 158 that is fitted to the reel 114 over its the annular wall 126. Thus, the disc 158 encloses the central cavity of the reel 114 and covers the wind-up spring (not shown). The interior facing side of this disc 158 is attached to the reel 114 via any appropriate method (e.g., adhesives, mechanical fasteners, etc.), preferably at its interface with the annular wall 126. In tested embodiments of the retractable modem cord device, the interior facing side of the disc was configured with two diametrically opposed posts 160 that extend from the periphery of the interior facing side of the disc. The location of these posts 160 is made to correspond with the location of the ramp-like protrusions 146 on the reel 114, which in the tested embodiments were hollow (as best seen in FIG. 2B) so that the disc posts 160 could be inserted into them. Thus, with the disc 158 installed onto the reel 114 with the posts 160 inserted into the hollows of the ramp-like protrusions 146, the disc is forced to rotate with the reel, just as it would if attached to the reel by any of the other methods mentioned previously. The exterior facing side of the disc 158 is visible via the opening 106 of the cover 104 (see FIG. 2A), or through the optional transparent window, as the case may be. In the former version of the disc 158, the exterior facing surface can be made flush with the interior wall 132 of the cover 104, or it can have a stepped configuration such that a central plateau extends up through the opening 106 (as in tested embodiments of the present invention and shown in FIG. 3). The central plateau would typically extend a distance that makes it flush with the exterior surface of the cover 104, however, this need not be the case. The aforementioned design is disposed on the exterior facing side of the disc 158, where persons viewing the retractable modem cord device can see it. This can be accomplished in a variety of ways. For example, the design can be formed as part of the surface of the disc 158, such as by embossing or engraving, or it can be formed on the surface of the disc, such as by the use of paints, inks, etc. Or alternately, a label or sticker having the design formed thereon could be attached to the exterior facing side of the disc 158. Since the disc 158 displaying the design is attached to the reel 114, it will rotate with the reel when the cord 14 is extended from or retracted into the case, thereby providing the interesting display discussed previously. It is noted that if a transparent window is employed, the window itself could include design elements that complement or complete the design on the disc 158. It is further noted that while it is preferred that the display take the form of a circular disc 158, other shapes are feasible as long as they do not interfere with the rotation of the reel 114 within the case.

While the invention has been described in detail by reference to the preferred embodiment described above, it is understood that variations and modifications thereof may be made without departing from the true spirit and scope of the invention. For example, while the present invention has been described in the context of a retractable modem cord device, the spinning display could be adapted to other devices as well. For example, other cables used to connect computers, and particularly the so-called mobile or portable computing devices, to various external devices, are often carried by a user. For instance, cables used for network connections such as RJ-11/RJ-45 network cables, or Universal System Bus (USB) cables, or IEEE 1394 cables (i.e., firewire cables), are often carried by a user. It would be possible to make these cables into retractable cable devices in a manner similar to the retractable modem cord device. Further, these devices can be configured with a spinning display as well.

Wherefore, what is claimed is:

1. A retractable cord apparatus, comprising:

a case having a viewing port on a front side thereof;

a rotatable display plate disposed within the case and having an exterior facing side which is at least partially visible from the outside via said viewing port; and an extendable and retractable cord housed inside said case; and wherein said display plate rotates whenever the cord is extended from the case or retracted back into the case.

2. The apparatus of claim 1, wherein the display plate is flush with the interior surface of the case adjacent the viewing port.

3. The apparatus of claim 1, wherein the viewing port is an opening in the case and the display plate extends through the opening.

4. The apparatus of claim 3, wherein the display plate extends only far enough to be flush with the exterior surface of the case adjacent the viewing port.

5. The apparatus of claim 1, wherein the rotatable display plate exhibits a design on its exterior facing side which is visible from the outside through said viewing port.

6. The apparatus of claim 5, wherein said design is formed as part of the exterior facing side of the display plate by embossing or engraving.

7. The apparatus of claim 5, wherein said design is formed over the surface of the exterior facing side of the display plate.

8. The apparatus of claim 7, wherein the design formed over the surface of the exterior facing side of the display plate comprises one of (i) paint, or (ii) ink.

9. The apparatus of claim 5, wherein said display plate comprises a label and a backing plate, and wherein said design is disposed on a front side of the label which acts as the exterior facing side of the display plate, and wherein the label is attached to the backing plate by its back side.

10. The apparatus of claim 1, wherein said viewing port comprises a transparent window.

11. The apparatus of claim 1, wherein the display plate is disc shaped.

12. The apparatus of claim 1, wherein the case, when viewed from its front side, comprises a shape approximating a circle.

13. The apparatus of claim 1, wherein the case, when viewed from its front side, comprises a shape approximating an ellipse.

14. The apparatus of claim 1, wherein the case, when viewed from its front side, comprises a shape approximating a polygon.

15. The apparatus of claim 1, wherein the viewing port, when viewed from the front side of the case, comprises a shape approximating a circle.

16. The apparatus of claim 1, wherein the viewing port, when viewed from the front side of the case, comprises a shape approximating an ellipse.

17. The apparatus of claim 1, wherein the viewing port, when viewed from the front side of the case, comprises a shape approximating a polygon.

18. The apparatus of claim 1, wherein the exterior facing side of said display plate comprises a shape approximating a circle.

19. The apparatus of claim 1, wherein the exterior facing side of said display plate comprises a shape approximating an ellipse.

20. The apparatus of claim 1, wherein the exterior facing side of said display plate comprises a shape approximating a polygon.

21. A retractable modem cord device, comprising:

a case having a viewing port on a front side thereof;

a rotatable display plate disposed within the case and having a design on an exterior facing side which is visible from the outside through said viewing port;

a telephone cord which is normally retracted within the case with the exception of the two ends thereof which extend outside the case through separate openings in the periphery of the case and which terminate with telephone-type connectors, said cord being manually extendable from the case by a user and under tension from within the case such that when extended from the case and released by the user, said tension on the cord causes it to retract back into the case; and wherein, said display plate rotates whenever the cord is extended from or retracted back into the case.

22. The device of claim 21, wherein said cord is manually extendable from the case by a user pulling on either of the two ends of the cable, and wherein any end not pulled on by the user is extended automatically whenever the other end is pulled on, thereby extending both ends of the cord simultaneously.

23. The device of claim 21, wherein the connectors are larger than said openings in the periphery of the case at their points of connection to the free ends of the cord so as to prevent the free ends of the cord from retracting into the case.

24. The device of claim 23, wherein the tension applied to the cord in a fully retracted mode is sufficient to hold the connectors against the periphery of the case.

25. The device of claim 24, further comprising two nooks, wherein whenever the cord is in the fully retracted mode, each connector is housed within the confines of a different one of the nooks, said nooks thereby providing protection to the connectors whenever the cord is fully retracted.

26. The device of claim 25, wherein the connectors are accessible when housed in the nooks so as to allow a user to grasp one or both of the connectors to pull thereon and extend the cord.

27. The device of claim 21, further comprising a locking and release mechanism having a lock which once the cord has been extended by the user prevents the cord from retracting back into the case substantially under the influence of said tension on the cord.

28. The device of claim 27, wherein the locking and release mechanism has a release which when manually activated by the user releases the lock, thereby allowing the cord to be retracted back into the case under the influence of said tension on the cord.

29. The device of claim 27, wherein the extended length of the cord is approximately 8 feet.

* * * * *